US005306312A

United States Patent [19]

Riggins et al.

[11] Patent Number: 5,306,312

[45] Date of Patent: Apr. 26, 1994

[54] DYE DIFFUSION PROMOTING AGENTS FOR ARAMIDS

[75] Inventors: Phillip H. Riggins; John H. Hansen, both of Greensboro, N.C.

[73] Assignee: Burlington Industries, Inc., Greensboro, N.C.

[21] Appl. No.: 851,781

[22] Filed: Mar. 16, 1992

Related U.S. Application Data

[63] Continuation-in-part of Ser. No. 606,572, Oct. 31, 1990, abandoned.

[51] Int. Cl.[5] ..... D06P 1/64; D06P 1/649; D06P 3/24; D06P 3/26

[52] U.S. Cl. ..... 8/586; 8/490; 8/925; 8/130.1

[58] Field of Search ..... 8/490, 586, 925, 130.1

[56] References Cited

U.S. PATENT DOCUMENTS

| | | | |
|---|---|---|---|
| 4,668,234 | 5/1987 | Vance et al. | 8/115.6 |
| 4,705,523 | 11/1987 | Hussamy | 8/490 |
| 4,705,527 | 11/1987 | Hussamy | 8/558 |
| 4,755,335 | 7/1988 | Ghorashi | 264/48 |
| 4,780,105 | 10/1988 | White et al. | 8/574 |
| 4,898,596 | 2/1990 | Riggins et al. | 8/490 |
| 4,981,488 | 1/1991 | Cates et al. | 8/574 |
| 4,985,046 | 1/1991 | Hartzler | 8/654 |
| 5,207,803 | 5/1993 | Holsten et al. | 8/586 |

FOREIGN PATENT DOCUMENTS

| | | |
|---|---|---|
| 355222 | 2/1990 | European Pat. Off. . |
| 478301 | 4/1992 | European Pat. Off. . |
| 1438067 | 6/1976 | United Kingdom . |

*Primary Examiner*—Paul Lieberman
*Assistant Examiner*—Margaret Einsmann
*Attorney, Agent, or Firm*—Nixon & Vanderhye

[57] ABSTRACT

Aramid and aramid-blend fabrics are dyed or flame-retardant treated or both dyed and flame-retardant treated using conventional heat dyeing equipment. Aliphatic amides capable of swelling the aramid fibers at least 1.5% and having 7 to 14 carbon atoms are used as diffusion-promoting agents for dyes, flame retardent agents or both. Odor-free, flame resistant, colored or colored and highly-flame resistant products result.

64 Claims, No Drawings

DYE DIFFUSION PROMOTING AGENTS FOR ARAMIDS

This application is a continuation-in-part of application 07/606,572 filed Oct. 31, 1990, now abandoned.

This invention relates to dyeing aramid fibers and/or improving the flame resistance of these fibers. Aramids and aramid blends are dyed and/or also flame-retardant treated in conventional dyeing equipment to produce an odor-free, colored, flame resistant or colored and highly-flame resistant product.

BACKGROUND OF THE INVENTION

Aramid fibers are highly resistant to heat decomposition, have inherent flame resistance, and are frequently used in working wear for special environments where flame resistance is required. Fabrics made of these fibers are extremely strong and durable, and have been widely adopted for military applications where personnel have the potential to be exposed to fire and flame, such as aircraft pilots, tank crews and the like. There is a need for dyed fabrics that have flame resistant properties even greater than the undyed fabrics or dyed fabrics. Metalinked aromatic polyamide fibers (aramid fibers) are made from high-molecular-weight polymers that are highly crystalline and have either a high or no glass transition temperature.

These inherent desirable properties of aramid fibers also create difficulties for fiber processing in other areas; specifically, aramids are difficult to dye. Fiber suppliers currently recommend a complicated exhaust dyeing procedure with a high carrier (acetophenone) content; the process is conducted at high temperatures over long periods of time and often results in a product having an unpleasant odor. Such dyeing conditions require substantial amounts of energy both to maintain dyeing temperature and for the treatment of waste dye baths.

Polar organic solvents have also been used to swell the fiber or create voids in the fiber structure to enhance dyeability. These procedures involve Bolvent treatments at elevated temperatures with subsequent dyeing. Another source of dyed aramid fiber is producer--dyed aramid yarn, prepared by solution dyeing in which typically a quantity of dye or pigment is mixed with the molten or dissolved polymer prior to extrusion of the polymer or solution into fine fibers; the dye or pigment becomes part of the fiber structure. Solution-dyed fibers are more costly than the undyed fibers due, in part, to the additional costs of manufacture, and must be used in the color provided by the supplier, leaving the user with only a limited choice of colors. Solution-dyed fibers offer relatively good lightfastness, whereas some undyed aramid fibers, particularly Nomex ® (DuPont) yellow following exposure to UV light.

A process has been described by Cates and others in commonly-assigned U.S. Pat. No. 4,759,770 for continuously or Bemi-continuously dyeing and simultaneously improving the flame-resistant properties of poly(m-phenyleneisophthalamide) fibers that includes the step of introducing the fiber into a fiber swelling agent consisting preponderantly of a polar organic solvent also containing at least one dye together with at least one flame retardant, thereby swelling the fiber and introducing both the dye and the flame retardant into the fiber while in the swollen state. The flame resistance/performance properties of fabrics dyed by this process are significantly improved. Limiting Oxygen Index (LOI) values, as described below, may be as high as 41% for simultaneously dyed and flame retarded T-455 Nomex fabric products produced by the process of this invention. As a means of comparison, undyed T-455 Nomex has an LOI of 27%. However, this process involves some equipment not routinely available on most existing processing lines.

Our earlier U.S. Pat. No. 4,898,596 describes a process for dyeing, flame-retardant treating or both dyeing and flame retardant treating aramid fabrics using N-cyclohexyl-2-pyrrolidone as a dye and/or flame retardant-diffusion promoting agent.

Our previous investigations have identified N-cyclohexyl-2-pyrrolidone, in U.S. Pat. No. 4,898,596 and the octylpyrrolidones, in Ser. No. 07/437,397 filed Nov. 16, 1989, as effective agents for promoting diffusion of dyes and/or flame retardant into aramid fibers. While highly effective for most applications, these materials are costly and presently commercially available from only a single source. We have more recently investigated other amide-type compounds and the relationship between compound structure and efficacy in promoting dyeing and/or flame resistance by durable uptake of phosphorus-containing flame retardants. We have now identified and hereby disclose a series of compounds useful for promoting the dyeing and/or flame retarding of aramid fibers or fabrics. These compounds offer the promise of reduced costs and improved effectiveness of methods of dyeing and finishing aramids.

In the course of this investigation, we have studied the relationship between the water solubility of polar organic solvents and their effectiveness as dye diffusion agents or flame retardant diffusion agents for aramids. It is well known that water-soluble polar organic solvents, such as dimethylformamide, dimethylsulfoxide, dimethylacetamide, methylpyrrolidone or ethylpyrrolidone, are effective dye diffusion promoters for aramids when used in a solvent system containing only a minor proportion of water, or no water at all. However, solvent-system dyeing procedures create possibilities of explosion, pollution, and solvent recovery. It is an object of the present invention to provide processes which use dye diffusion promoters as a minor proportion (about 0.5% to 6%) of the dye bath, as dyeing assistants. Such processes reduce or eliminate the problems mentioned immediately above, and can effect a major reduction in cost and a major improvement in convenience.

In studying candidate amide diffusion promoters as assistants for dyeing or flame retarding aramids, we have discovered that water-soluble polar solvents are ineffective when used in a low concentration, such as 0.5% to 6.0% by weight. This is because little of the water-soluble solvent enters into the aramid fiber to promote swelling and diffusion of dye and/or flame retardant into the fiber; the major portion remains in the dyebath, where it is ineffective. We have discovered that for aramid diffusion agents to be effective, they must have low water solubility under the conditions of dyeing, but not be completely insoluble, since some solubility is necessary for the diffusion agent to reach and penetrate the aramid fibers. Thus, a balance between hydrophilic and lipophilic character is necessary. This property can be measured by water solubility tests, but data are not available in the literature for solubility of amide dye diffusion agents at the temperatures and other conditions used in dyeing.

The hydrophile/lipophile balance can be measured approximately in an homologous series of monoamides by certain secondary properties such as molecular weight, number of carbon atoms in the structure, or percent nitrogen content, since the nitrogen-containing amide groups are responsible for the hydrophilic character of the molecule. However, we have chosen to use a standardized dyeing procedure which measures depth of dyeing and the extent of swelling of the aramid fiber, designated as the "Swelling Value". This procedure, and the criteria for its use, are described in detail below.

It is an object of the present invention to provide a process for dyeing an aramid fiber such as Nomex ®. It is also an object to provide a process for simultaneously dyeing and not detracting from the inherent strength of the aramid fibers. It is also an object to provide a process suitable to conventional equipment such as pressure jets, dye becks or similar machines. It is particularly an object to provide a process for the preparation of dyed, "super FR" Nomexs fabrics of high LOI of 37%–44% as described in the Cates et al patent U.S. No. 4,759,770.

SUMMARY OF THE INVENTION

Disclosed is a process for dyeing or flame retardant treating, or if preferred, both dyeing and simultaneously improving the flame-resistant properties of poly(m-phenyleneisophthalamide) fibers. The process includes the steps of introducing the fiber into a fiber dyeing solution containing a tinctorial amount of at least one dye in combination with selected dye diffusion promoters as defined below, and, optionally, at least one flame retardant, especially chloroalkyl diphosphate esters such as Antiblaze 100, optionally also containing sodium nitrate, then heating the fiber and solution at a temperature and for a sufficient period of time to dye and flame retardant treat (when flame retardant is present) the fibers.

In another embodiment of the invention, we have discovered the advantages of a two-step process in which a dye diffusion promoting agent is applied in an initial step prior to further processing such as dyeing or treating with a flame retardant or both. Initial treatment with a dye diffusion promoting agent leaves residual promoting agent on the aramid fabric, which may then be sold to processors in this condition for subsequent dyeing and/or flame retardant treating. The separate application of the dye diffusion promoting agent prior to dyeing sometimes results in a better dyeing than does the use of the dye diffusion promoting agent directly with the dye(s) as well as higher levels of flame resistance.

The two-step process allows for the dyeing of fully or partially constructed garments by first treating the fabric width the dye diffusion promoting agent, an effective amount of which remains on the fabric. A garment is then fully or partially constructed and dyed to the appropriate shade.

A carrier in amounts preferably up to 10% by weight may be used in conjunction with the dye diffusion promoter. These carriers are conventionally used in the art and include ethylene glycol phenyl ether (Dowanol EPH) and butyl/propyl phthalimide (Carolid NOL).

Certain ultraviolet absorbers such as Ultrafast 830 when included in the dyeing system produced an improvement of half a grade (on the gray scale) in lightfastness. An additional half grade improvement is usually obtained by a topical post-treatment with a UV absorber.

Another aspect of this invention is that dyeing and flame retardant fixation can be obtained at atmospheric pressure and at temperatures below the boil. Useful color and flame retardant fixation can be achieved at 98° C. with somewhat lower degrees of color fixation when the same treatment is applied at 82° C.

Flame retardants are applied in a range of about 3% to about 20% based on weight of fabric for the exemplified flame retardant Antiblaze 100, with a preferred range of from 6% to 15%, and a most preferred range of from 6% to 9%.

Amide dye diffusion and/or flame retardant promoting agents may be unsubstituted, monosubstituted or disubstituted, containing from 7 to 20, desirably 10 to 12, carbon atoms attached to the nitrogen atom. The amide dye diffusion agents suited to the process of the present invention are those exhibiting a swelling value of at least 1.5%, greater than the control as described below, and exclude both N-cyclohexyl-2-pyrrolidone and N-octyl-2-pyrrolidone.

The dye diffusion and/or flame retardant promoting agents of this invention desirably cause an enhanced uptake of dye and/or flame retardant by the aramid fabric, and result in a swelling value as herein defined at least 1.5% greater than the control. This convenient procedure serves to distinguish the more effective and useful amides from relatively ineffective and less useful amides as characterized by less swelling.

The test was conducted as follows: A bath weighing 200g was prepared containing 0.2g of Acid Blue 62 and 6g of the candidate dye diffusion promoting agent. In this aqueous bath, log of weighed Nomex fabric, conditioned at 70° F. and 65% RH, was dyed at 130° C. for 1.5 hours.

After dyeing, the fabric was rinsed in warm tap water, and then scoured in fresh tap water at 1000° C. in the Ahiba Vistamatic apparatus for 15 minutes. The bath was cooled and discarded, and the fabric was rinsed in fresh tap water, squeezed to remove excess liquid and allowed to air dry overnight. The fabric was then rinsed twice in cold, fresh acetone, air dried, and conditioned prior to weighing. The change in weight compared with the initial conditioned weight is the Swelling Value, with a positive value indicating a gain in weight, and a negative value indicating a loss.

This technique permits rapid selection of the more effective agents and provides useful information for assembling structure-activity relationships. For example, low-molecular weight pyrrolidones, benzamides and dimethylamides were unremarkable promoters. There were fairly narrow intervals in several homologous series over which effective dye or flame retardant promotion was observed. The benzamides, chosen as a specific sub-group of the amides are typical:

| | | |
|---|---|---|
| dimethylbenzamide | poor | 9 carbons |
| diethylbenzamide | good | 11 carbons |
| dipropylbenzamide | good | 13 carbons |
| dibutylbenzamide | poor | 15 carbons |

It will be apparent that variations on this process are possible, such as use of other flame retardants, or other temperatures or times.

Other effective flame retardants suited for use in the process and offering acceptable flame resistance and durability %-,o laundering include halophosphate esters, phosphates and phosphonates of particular types.

These include AB-100, a chloroalkyl diphosphate ester, AB-80, a trichloropropylphosphate, and DBBP, a dibutylbutylphosphonate (all products of Albright and Wilson); Fyrol CEF and Fyrol PCF, respectively trichloroethylphosphate and trichloropropylphosphate, and TBP, tributylphosphate (products of Stauffer Chemical Co.), XP 60A and XP 60, both halophosphate esters (products of Virkler); and HP-36, a halogenated phosphate ester available as a pale yellow, low viscosity liquid containing 35 to 37% bromine, 8–9.5% chlorine and 6–8% phosphorus (a product of Great Lakes Chemical Corporation).

The flame resistance/performance properties of fabrics dyed by the process of this invention are significantly improved, far better than if aftertreated with a flame-retardant finish applied from an aqueous solution following the dyeing operation. LOI values, as described in more detail below, may be as high as 41% for the simultaneously dyed and flame retarded T-455 Nomex® fabric product produced by the process of this invention. As a means of comparison, undyed T-455 Nomex® has an LOI of 27%.

Both dyeing and flame retarding are affected by the concentration of the dye diffusion promoting agents. As an illustration, we have obtained dye and FR fixation in this process using dye diffusion promoting agent concentrations of 10 to 120 percent on weight of fabric with best results at the 20 to 50 percent or higher level. Results are also affected by the liquor-to-fabric ratio. Workable ratio are 40:1 to 4:1. Typical liquor-to-fabric ratio for this work has been 15:1, although in production ratios as low as 5:1 may be used with 7:1 considered normal. Residual agent is removed by scouring at the boil. The results of dyeing experiments using a variety of dye-diffusion promoting agents are described in Table 1.

Fibers suitable for the process of this invention are known generally as aromatic polyamides. This class includes a wide variety of polymers as disclosed in U.S. No. 4,324,706, the disclosure of which is incorporated by reference. Our experience indicates that not all types of aromatic polyamide fibers are equally well dyed by this process; some fibers are not affected sufficiently by the amide dye promoter to allow the dye to enter the fiber and are only surface stained, not fully dyed. Thus, the principal fibers amenable to the process of this invention are made from a polymer known chemically as poly(in-phenylene-isophthalamide), i.e., the meta isomer which is the polycondensation product of metaphenylenediamine and isophthalic acid. Below is a listing of fibers now commercially available identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

Our experience indicates that fibers of the para isomer, POLY(p-phenyleneterephthalamide) represented commercially by DuPont's Kevlar® and Enka-Glanzstoff's Arenka®, are usually stained or changed in color, but are not easily dyed by the process of this invention. Accordingly, as used in the text of this application and in the claims that follow, the expressions "aramid" and "aromatic polyamide fiber", when pertaining to the novel process of this invention, will signify the meta isomer unless otherwise specified.

Nomex® T-455, a blend of 95% Nomex and 5% Kevlar, is difficult to dye to a fully acceptable deep, even shade due to the presence of a minor amount of non-dyed para isomer leading to a "frosty"appearance of the dyed goods. We have found that the specific combination of amide promoters and basic dyes effectively colors the para isomer and eliminates "frostiness" of the blended fabric.

A preferred flame retardant is Antiblaze® 100 (Mobil Oil Corp.), CAS registry number 38051-10-4. It has the following structure:

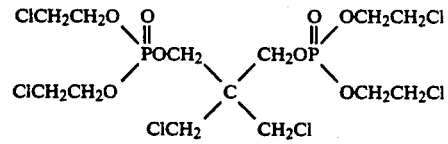

Flame retardant concentrations in the treatment bath are 0.5% to about 20% (based on weight of fabric) are contemplated. However, the upper limit as a practical matter will be determined by the degree of performance required balanced against the cost of the FR chemical or system used. Concentrations in the range of about 3% to about 20% have been shown to be effective in increasing LOI values.

Limiting Oxygen Index (LOI) is a method of measuring the minimum oxygen concentration expressed as volume % needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

DESCRIPTION OF THE PREFERRED EMBODIMENTS

The following examples offered are by illustration and not by way of limitation. All parts and percentages herein are given by weight unless otherwise specified.

Additional assessments, comparisons and other useful information suggest themselves from the examples that follow.

1. Dyeing—A bath weighing 200g was prepared containing 0.2g of Acid Blue 62 and 6g of the candidate dye diffusion promoting agent. In this aqueous bath, 10g of weighed Nomex fabric, conditioned at 70° F. and 65% RH, was dyed at 1300° C. for 1.5 hours.

After dyeing, the fabric was rinsed in warm tap water, and then scoured in fresh tap water at 1000° C. in the Ahiba Vistamatic apparatus for 15 minutes. The bath was cooled and discarded, and the fabric was rinsed in fresh tap water, squeezed to remove excess liquid and allowed to air dry overnight. The fabric was then rinsed twice in cold, fresh acetone, air dried, and conditioned prior to weighing. The change in weight compared with the initial conditioned weight is reported in Table 1 as the Swelling Value, with a positive value indicating a gain in weight, and a negative value indicating a loss.

2. Application of Flame Retardant—In Procedure A, dyeing and flame retarding were conducted simultaneously, using the dyeing procedure described above, but with the extra addition of 1g of Antiblaze 100 to the bath.

In Procedure B, dyeing was conducted as described in the procedure described above, without flame retardant. After drying, the fabrics were rinsed twice in boiling water. The rinsed fabrics were then treated with flame retardant as follows: One gram of Antiblaze 100 was dispersed in 200g of water with the aid of 0.2g of Merpol HCS surfactant. The fabric was then heated in the dispersion of flame retardant for 1.5 hours at 1300° C. The treated fabric was then rinsed with water and acetone as described above in order to determine the Swelling Value.

RESULTS

The results of dyeing experiments, and of combined dyeing and flame retarding experiments, are summarized in Table 1.

TABLE 1

Comparison of Dye Diffusion Promoting Agents

| | | Dyed Only | | | Dyed and Flame-Retarded | | | | |
|---|---|---|---|---|---|---|---|---|---|
| | | | | | Procedure A | | Procedure B | | |
| No. | Chemical | No. of Carbons | Depth of Dyeing | Swelling Value % | Add-on % | P % | Swelling Value % | P % | LOI % |
| 1. | Blank (control) | 0 | v. light | −1.5 | −1.6 | 0.01 | — | — | — |
| 2. | Lauramide | 12 | v. light | — | — | — | — | — | — |
| 3. | Butylbenzamide | 11 | medium | 6.1 | — | — | — | — | — |
| 4. | Cyclohexylbenzamide | 13 | light | — | — | — | — | — | — |
| 5. | Dibutylformamide | 9 | dark | 1.5 | 6.9 | .16 | 4.3 | .45 | 40.7 |
| 6. | Dipropylacetamide | 8 | medium | 2.6 | 4.4 | .41 | — | — | — |
| 7. | Dibutylacetamide | 10 | dark | 4.5 | 6.9 | .10 | 3.5 | .26 | 34.4 |
| 8. | Dipropylpropionamide | 9 | dark | 3.9 | 6.0 | .36 | — | — | — |
| 9. | Dibutylpropionamide | 11 | v. light | −.7 | .1 | .01 | −1.2 | .02 | 28.1 |
| 10. | Dipropylbutyramide | 10 | light-med. | 1.8 | — | — | — | — | — |
| 11. | Dibutylbutyramide | 12 | v. light | −.5 | — | — | — | — | — |
| 12. | Dimethylhexamide | 8 | med.-dark | .9 | 7.9 | .66 | — | — | — |
| 13. | Diethylhexamide | 10 | medium | 3.3 | 4.0 | .06 | 1.1 | .08 | 28.2 |
| 14. | Hallcomid H-8-10* | 10-12 | medium | 3.9 | — | — | — | — | — |
| 15. | Dimethylcaprylamide | 10 | dark | 2.2 | 5.9 | .08 | 2.7 | .22 | 36.2 |
| 16. | Dimethylcapramide | 12 | v. light | −.2 | −.8 | .02 | −1.0 | .02 | 27.8 |
| 17. | Dimethylbenzamide | 9 | v. light | −.5 | 1.5 | .16 | 1.1 | .16 | 34.4 |
| 18. | Diethylbenzamide | 11 | dark | 3.6 | 11.1 | .56 | — | — | — |
| 19. | Dipropylbenzamide | 13 | dark | 7.2 | 7.3 | .07 | 4.0 | .20 | 32.9 |
| 20. | Dibutylbenzamide | 15 | v. light | −.9 | −.5 | .01 | −1.2 | .01 | 28.1 |
| 21. | Ethylpyrrolidone | 6 | v. light | −.7 | −.6 | .03 | — | — | — |
| 22. | Cyclohexylpyrrolidone | 10 | dark | 5.5 | 10.2 | .59 | 4.4 | .40 | 40.4 |
| 23. | n-Octylpyrrolidone | 12 | dark | .1 | 3.9 | .07 | 4.3 | .41 | 36.7 |
| 24. | Benzoylmorpholine | 11 | v. light | −.8 | — | — | — | — | — |
| 25. | Dihexanoylpiperazine | 16/2 | medium | — | — | — | — | — | — |

*Dimethylamide of mixed $C_8$ and $C_{10}$ acids.

1. Dyeing—Among the monosubstituted amides (Nos. 2-4), only the butylbenzamide showed some promise as a dye diffusion agent. Among the disubstituted amides (Nos. 5-20), and the pyrrolidones (Nos. 21-23), which can also be considered disubstituted amides), the following dye diffusion promotion agents all produced dark dyeing and are of special interest:

| No. | Chemical | No. of Carbons | Swelling Value |
|---|---|---|---|
| 5 | Dibutylformamide | 9 | 1.5 |
| 7 | Dibutylacetamide | 10 | 4.5 |
| 8 | Dipropylpropionamide | 9 | 3.9 |
| 12 | Dimethylhexamide | 8 | .9 |
| 15 | Dimethylcaprylamide | 10 | 2.2 |

-continued

| No. | Chemical | No. of Carbons | Swelling Value |
|---|---|---|---|
| 18 | Diethylbenzamide | 11 | 3.6 |
| 19 | Dipropylbenzamide | 13 | 7.2 |
| 22 | Cyclohexylpyrrolidone | 10 | 5.5 |
| 23 | n-Octylpyrrolidone | 12 | .1 |

These dye diffusion promoting agents all contain between 8 and 13 carbon atoms in their structure and show a positive dyed-only swelling value. Those amides containing less than 7 or more than 14 carbon atoms (Nos. 21 and 20) were ineffective, as were all the structures producing a negative dyed-only swelling value. It thus appears that a combination of two properties—7 to 14 carbon atoms in the molecular structure and a positive swelling value—is sufficient to define an effective class of dye diffusions promoting agents for fibers such as Nomex.

2. Dyeing and Flame Retarding—Two separate procedures for dyeing and flame retarding have been described above. In Procedure A, dyeing and flame retarding were conducted simultaneously, while in Procedure B, the flame retardant wall applied at a later step. Examination of the results in the last five columns of Table I indicates that Procedure B is surprisingly effective in imparting enhanced flame resistance to Nomex Fibers, in spite of the fact that much of the diffusion promoting agent has been removed by scouring. This result suggests that the diffusion promoting agent has produced a change in the structure of the Nomex which makes it easier for flame retardant, and possibly dyes, to enter the fiber. Procedure B is useful for a two-step process for flame retarding Nomex or for the printing of patterns on Nomex fabric dyed to a solid background shade.

What is claimed is:

1. A process of dyeing poly(m-phenyleneiso-phthalamide) fabric comprising:

(a) dyeing the fabric at a temperature in the range of about 1000° C. to about 1500° C. and elevated pressure in a fiber-dyeing solution containing a tinctorial amount of at least one dye and a dye diffusion promoting amount of an alphatic amide having 7 to 14 carbon atoms capable of increasing the swelling ratio of the fabric at least 1.5% and excluding N-octyl-2-pyrrolidone and N-cyclohexyl-2-pyrrolidones, then (b) heating the fabric while in contact with the solution until the desired degree of dyeing is attained.

2. The process of claim 1 in which the dye is an acid, direct or disperse dye.

3. The process of claim 1, in which the amount of dye diffusion promoting agent is from about 10 to 120 percent by weight of fabric.

4. The process of claim 1, in which the ratio of dyeing solution to fabric is from about 40:1 to about 4:1 by weight of fabric.

5. The process of claim 1, including the additional step of (3) scouring in hot water to remove any residual amide from the fabric.

6. The process of claim 1, in which the fabric is dyed at a temperature of about 1300° C.

7. The process of claim 1, in which the fabric is dyed for about 15 minutes to about 2 hours.

8. The process of claim 1, in which the fabric is a blend of poly(m-phenyleneisophthalamide) and poly(p-phenyleneterephthalamide) fibers, and the dye is a basic dye.

9. A process of dyeing a blend of poly(m-phenyleneisophthalamide) and poly(p,-phenyleneterephthalamide) fibers comprising:

(a) treating the fibers at a temperature in the range of about 1000° C. to about 1500° C. and elevated pressure in a solution containing a tinctorial amount of a basic dye and a dye diffusion promoting amount of an aliphatic amide having 7 to 14 carbon atoms capable of increasing the swelling ratio of the fabric at least 1.5% and excluding N-octyl-2-pyrrolidone and N-cyclohexyl-2-pyrrolidone, then (b) heating the fabric in the solution until the poly(m-phenyleneisophthalamide) fibers have been dyed and the poly(p-phenyleneterephthalamide) fibers have been stained.

10. The process of claim 9, in which the fabric is a blend of 5% by weight of poly(p-phenyleneterephthalamide) fibers, balance poly(m-phenyleneisophthalamide) fibers.

11. The process of claim 9, in which the fabric is treated at a temperature of about 130° C.

12. The process of claim 9, in which the fabric is treated for about 15 minutes to about 2 hours.

13. A process of flame-retardant treating poly(m-phenyleneisophthalamide) fabric comprising:

(a) treating the fabric with flame retardant at a temperature in the range of about 100° C. to about 1500° C. and elevated pressure in a fiber-treating solution containing a flame-retarding amount of at least one flame retardant and a flame retardant diffusion promoting amount of an aliphatic amide having 7 to 14 carbon atoms capable of increasing the swelling ratio of the fabric at least 1.5% and excluding N-octyl-2-pyrrolidone and N-cyclohexyl-2-pyrrolidone, then (b) heating the fabric while in contact with the solution until the desired degree of flame retardant fixation is attained.

14. A process of simultaneously dyeing and flame-retardant treating poly(m-phenyleneisophthalamide) fabric comprising:

(a) dyeing and flame-retardant treating the fabric at a temperature in the range of about 1000° to about 1500° C. and elevated pressure in a fiber-treating solution containing a tinctorial amount of at least one dye, a flame-retarding amount of at least one flame retardant and a flame retardant diffusion promoting amount of an aliphatic amide having 7 to 14 carbon atoms capable of increasing the swelling ratio of the fabric at least 1.5% and excluding N-octyl-2-pyrrolidone and N-cyclohexyl-2-pyrrolidone, then (b) heating the fabric while in contact with the solution until the desired degree of dyeing or flame resistance or both is attained.

15. The process of claim 13 or 14, in which the amount of diffusion promoting agent is from about 10% to about 120% by weight of fabric.

16. The process of claim 15, in which the ratio of treating solution to fabric is from about 40:1 to about 4:1.

17. The process of claim 13 or 14, including the additional step of (3) scouring in hot water to remove any residual amide from the fabric.

18. The process of claim 13 or claim 14, in which the fabric is treated in step (a) at a temperature of about 130° C.

19. The process )of claim 13 or 14, in which the fabric is treated in step (a) for about 15 minutes to about 2 hours.

20. The process of claim 14, in which the fabric is a blend of poly(m-phenyleneisophthalamide) and poly(p-phenyleneterephthalamide).

21. A process of dyeing poly(m-phenyleneisophthalamide) fabric comprising:

(a) dyeing the fabric at a temperature of from about 700° C. to about 1000° C. at atmospheric pressure in an aqueous dyebath containing a tinctorial amount of at least one dye and a dye diffusion promoting agent consisting of an aliphatic amide having 7 to 14 carbon atoms capable of increasing the swelling ratio of the fabric at least 1.5% and excluding N-octyl-2-pyrrolidone and N-cyclohexyl-2-pyrrolidone, then (b) heating the fabric while in contact with the treating solution until the desired degree of dyeing is attained.

22. The process of flame-retardant treating poly(m-phenyleneisophthalamide) fabric comprising:

(a) flame-retardant treating the fabric at a temperature of about 700° C. to about 100° C. at atmospheric pressure in an aqueous bath containing a flame-retarding amount of at least one flame retardant and a diffusion promoting amount of at least one aliphatic amide having 7 to 14 carbon atoms capable of increasing the swelling ratio of the fabric at least 1.5% and excluding N-octyl-2-pyrrolidone and N-cyclohexyl-2-pyrrolidone, then (c) heating the fabric while in contact with the treating solution until the desired degree of flame retardant fixation is attained.

23. A process for simultaneously dyeing and flame-retardant treating poly(m-phenyleneisophthalamide) fabric comprising:

(a) dyeing and flame-retardant treating the fabric at atmospheric pressure in an aqueous dyebath containing a tinctorial amount of at least one dye, a flame-retarding amount of at least one flame retardant and a diffusion-promoting amount of an aliphatic amide having 7 to 14 carbon atoms capable of increasing the swelling ratio of the fabric at least 1.5% and excluding N-octyl-2-pyrrolidone and N-cyclohexyl-2-pyrrolidone, then (b) heating the fabric while in contact with the treating solution until the desired degree of dyeing or flame resistance or both is attained.

24. The process of claim 21, 22 or 23, in which the amount of diffusion promoting agent is from about 10 to about 120% by weight of fabric.

25. The process of claim 24, in which the ratio of treating solution to fabric is from about 40:1 to about 4:1 by weight.

26. The process of claim 21, 22 or 23, including the additional step of (c) scouring in hot water to remove any residual amide from the fabric.

27. The process of claim 21, 22 or 23, in which the fabric is treated in step (a) at a temperature in the range of about 700° C. to about 980° C.

28. The process of claim 27, in which the fabric is treated in step (a) for about 15 minutes to about 2 hours.

29. The process of claim 21, 22 or 23, in which the fabric is a blend of poly(m-phenyleneisophthalamide) and poly(p-phenyleneterephthalamide) fibers.

30. A process of dyeing poly(m-phenyleneisophthalamide) fabric comprising:

(a) applying to a poly(m-phenyleneisophthalamide textile fabric a solution containing a tinctorial amount of at least one dye and a dye-diffusion promoting amount of an aliphatic amide having 7 to 14 carbon atoms capable of increasing the swelling ratio of the fabric at least 1.5% and excluding N-octyl-2-pyrrolidone and N-cyclohexyl-2-pyrrolidone, then (b) heating the fabric while in contact with the solution until the desired degree of dyeing is attained.

31. A process of flame-retardant treating poly(m-phenyleneisophthalamide) fabric comprising:

(a) applying to the textile fabric flame-retardant diffusion promoting amount of an aliphatic amide having 7 to 14 carbon atoms capable of increasing the swelling ratio of the fabric at least 1.5% and excluding N-octyl-2-pyrrolidone and N-cyclohexyl-2-pyrrolidone, (b) flame-retardant treating the fabric at a temperature in the range of about 1000° C. to about 1500° C. and elevated pressure in a fiber-treating solution containing a flame-retarding amount of at least one flame retardant, then, (c) heating the fabric while in contact with the solution until the desired degree of flame-retardant fixation is attained.

32. A process of flame-retardant treating and dyeing poly(m-phenyleneisophthalamide) fabric comprising:

(a) flame-retardant treating the fabric in a solution containing a flame-retarding amount of at least one flame retardant and a diffusion-promoting amount of an aliphatic amide having 7 to 4 carbon atoms capable of increasing the swelling ratio of the fabric at least 1.5% and excluding N-octyl-2-pyrrolidone and N-cyclohexyl-2-pyrrolidone, (b) dyeing the fabric of step (a) at a temperature in the range of about 100° C. to about 1500° C. at elevated pressure in a solution containing a tinctorial amount of at least one dye, then (c) heating the fabric while in contact with the solution until the desired degree of dyeing or flame resistance or both is attained.

33. An aqueous dyelgath for dyeing poly(m-phenylene-isophthalamide) textile fabrics consisting essentially of:

a tinctorial amount of at least one dye; and a dye diffusion promoting amount of an aliphatic amide having 7 to 14 carbon atoms capable of increasing the swelling ratio of the fabric at least 1.5%.

34. A dyeing assistant which on dilution with water provides a dye diffusion promoting amount of an aliphatic amide having 7 to 14 carbon atoms capable of increasing the swelling ratio of the fabric at least 1.5%, and which with the addition of a tinctorial amount of at least one dye provides a dyebath suitable for dyeing poly(m-phenyleneisophthalamide) textile fabrics.

35. A dyebath for simultaneously dyeing and flame retarding poly(m-phenyleneisophthalamide) textile fabrics consisting essentially of:

a tinctorial amount of at least one dye;

a dye diffusion promoting amount of an aliphatic amide having 7 to 14 carbon atoms capable of increasing the swelling ratio of the fabric at least 1.5%; and 0.05% to 5%, based on the weight of the dyebath, of a flame retardant.

36. A dyeing and flame retarding assistant which on dilution with water provides a dye diffusion promoting amount of an aliphatic amide having 7 to 14 carbon atoms capable of increasing the swelling ratio of the fabric at least 1.5%; and a concentration of a neutral chloroalkyl diphosphate ester flame retardant of 0.05% to 5%, and which with the addition of at least one dye provides a dyebath suitable for simultaneously dyeing and flame retarding poly(m-phenyleneisophthalamide) textile fabrics.

37. A poly(m-phenyleneisophthalamide) textile fabric, or yarn containing with little fibers a dye diffusion promoting amount of an aliphatic amide having 7 to 14 carbon atoms capable of increasing the swelling ratio of the fabric at least 1.5%.

38. A process of dyeing a poly(m-phenyleneisophthalamide) textile fabric comprising the successive steps of:

(a) supplying a poly(m-phenyleneisophthalamide) textile fabric having thereon a dye diffusion promoting amount of an aliphatic amide having 7 to 14 carbon atoms capable of increasing the swelling ratio at least 1.5% and excluding N-octyl-2-pyrrolidone and N-cyclohexyl-2-pyrrolidones, then (b) applying a tinctorial amount of at least one dyestuff to the fabric and then (c) drying, then Breaming the thus-treated fabric with saturated steam or superheated steam at an elevated temperature of at least about 100° C. for a time sufficient to permeate and fix the dyestuff inside the poly(m-phenyleneisophthalamide) fibers.

39. The process of claim 38, in which the fabric of step (a) contains from about 10 to about 120% by weight of the amide.

40. The process of claim 38, in which, prior to step (a), an aqueous bath containing the amide is applied to the fabric.

41. The process of claim 38, including the additional step of (d) scouring in hot water to remove any residual amide remaining on the fabric.

42. The process of claim 38, in which the fabric is composed of poly (m-phenyleneisophthalamide) blended with up to 50% of other fibers.

43. The process of claim 42, in which the fibers blended with the poly(m-phenyleneisophthalamide) are at least one of poly(p-phenyleneterephthalamide), polybenzimidazole, flame-resistant cotton, flame-resistant rayon, nylon, wool or modacrylic fibers.

44. The process of claim 38, in which the fabric consists entirely of poly(m-phenyleneisophthalamide).

45. The process of claim 38, in which at least one of a flame retardant, an ultra-violet light absorber, an antistatic agent, or a water repellent is also applied to the fabric in step (b).

46. A process of printing a predetermined pattern on a poly(m-phenyleneisophthalamide) textile fabric comprising the successive steps of:

(a) supplying a poly(m-phenyleneisophthalamide) textile fabric having thereon a dye diffusion promoting amount of an aliphatic amide having 7 to 14 carbon atoms capable of increasing the swelling ratio at least 1.5% and excluding N-octyl-2-pyrrolidone and N-cyclohexyl-2-pyrrolidones, then (b) applying onto the fabric a print paste consisting essentially of a tinctorial amount of at least one dyestuff, a print paste thickening agent, and water, in a predetermined pattern; and then (c) drying, then steaming the thus-treated fabric with saturated steam or superheated steam at an elevated temperature of at least about 1000° C. for a time sufficient to permeate and fix the dyestuff inside the poly(m-phenyleneisophthalamide) fibers.

47. The process of claim 46, in which the fabric of step (a) contains from about 10 to about 120% by weight of the amide.

48. The process of claim 46, in which, prior to step (a), an aqueous bath containing the amide is applied to the fabric.

49. The process of claim 46, in which the fabric of step (a) has been dyed to a predetermined base shade using the amide as the dye diffusion promoter and also contains a flame retardant thereon.

50. The process of claim 46, including the additional step of (d) scourging hot water to remove any residual amide remaining on the fabric.

51. The process of claim 46, in which the fabric is composed of poly(m-phenyleneisophthalamide) blended with up to 50% of other fibers.

52. The process of claim 51, in which the fibers blended with the poly(m-phenyleneisophthalamide) are at least one of poly(p-phenyleneterephthalamide), polybenzimidazole, flame-resistant cotton, flame-resistant rayon, nylon, wool or modacrylic fibers.

53. The process of claim 46, in which the fabric consists entirely of poly(m-phenyleneisophthalamide).

54. The process of claim 46, in which the print paste additionally contains at least one of a flame retardant, an ultra-violet light absorber, an antistatic agent, or a water excellent.

55. The process of claim 46, in which steaming of the print pattern is performed in superheated steam at a temperature of bout 150° C. to 210° C.

56. A process of printing a predetermined pattern on a textile fabric composed of poly(m-phenyleneisophthalamide) comprising the steps of:

(a) applying onto a poly(m-phenyleneisophthalamide)-containing fabric in a predetermined pattern a print paste consisting essentially of a dye diffusion promoting amount of an aliphatic amide having 7 to 14 carbon atoms capable of increasing the swelling ratio at least 1.5% and excluding N-octyl-2-pyrrolidone and N-cyclohexyl-2-pyrrolidionel, at least one dyestuff compatible with the amide, a print paste thickener compatible with the amide, and water and, thereafter, (b) drying and curing the thus treated fabric at an elevated temperature of about 100° C. to about 210° C. and for a time sufficient to permeate and fix the dyestuff inside the poly(m-phenyleneisophthalamide) fibers.

57. The process of claim 56, in which in step (b) the curing is conducted in saturated steam at bout 100° C.

58. A print paste for printing and dyeing poly(m-phenyleneisophthalamide) textile fabric in a predetermined pattern, the print paste consisting essentially, in percent by weight, of:

about 10 to 120% of an aliphatic amide having 7 to 14 carbon atoms capable of increasing the swelling ratio, at least 1.5% and excluding N-octyl-2-pyrrolidone and N-cyclohexyl-2-pyrrolidone, to introduce a compatible dyestuff into the poly(m-phenyleneisophthalamide) fibers;

a tinctorial amount of at least one organic dyestuff soluble in an aqueous solution of the amide and capable of dyeing and fixing in the fibers:

a print paste thickener soluble in an aqueous solution of the amide and compatible with the other ingredients of the print paste, the thickener present in an amount sufficient to provide printing viscosity, balance water.

59. The print paste of claim 58, in which the dyestuff is an acid, basic, mordant, direct, metallized, disperse or reactive dye.

60. The print paste of claim 58, also containing at least one flame retardant.

61. A process for pretreating poly(m-phenyleneisophthalamide) fibers or fabric comprising applying to said fiber or fabric a dye-enhancing or flame-retardant enhancing amount of an aliphatic amide having 7 to 14 carbon atoms capable of increasing the swelling ratio at least 1.5% and excluding N-octyl-2-pyrrolidone and N-cyclohexyl-2-pyrrolidone.

62. The process of claim 61, in which the poly(m-phenyleneisophthalamide) fibers or fabric contain up to about 50% by weight of the amide.

63. The process of claim 61, in which the poly(m-phenyleneisophthalamide) fibers or fabric contain from 10% to about 120% by weight of the amide.

64. Poly(m-phenyleneisophthalamide) fibers or fabric having from 10% to 120% by weight of an aliphatic amide having 7 to 14 carbon atoms capable of increasing the swelling ratio at least 1.5% and excluding N-octyl-2-pyrrolidone and N-cyclohexyl-2-pyrrolidone to make the fibers or fabric receptive to dyeing, printing or flame retardant treating.

* * * * *

UNITED STATES PATENT AND TRADEMARK OFFICE

CERTIFICATE OF CORRECTION

PATENT NO. : 5,306,312
DATED : April 26, 1994
INVENTOR(S) : RIGGINS ET AL

It is certified that error appears in the above-identified patent and that said letters patent is hereby corrected as shown below:

Column 1, line 25, replace "Metalinked" with --Meta-linked--.
Column 1, line 41, replace "Bolvent" with --solvent--.
Column 1, line 58, replace "Bemi-continuously" with --semi-continuously--.
Column 1, lines 66 and 67, delete "p-" at the end of line 66 and replace "erformance" with --performance-- at the start of line 67.
Column 3, line 54, replace "width" with --with--.
Column 4, line 18, delete the comma after "1.5%".
Column 4, line 32, replace "log" with --10g--.
Column 4, line 36, replace "1000°C." with --100°C.--.
Column 4, line 67, replace "%-,o" with --to--.
Column 5, line 48, replace "poly(in-phenylene-isophthalamide)" with --poly(m-phenyleneisophthalamide)--.
Column 5, line 63, replace "POLY" with --poly--.
Column 6, line 24, replace "are" with --from--.
Column 6, line 58, replace "1300°C." with --130°C.--.
Column 6, line 60, replace "1000°C." with 100°C.--.
Column 7, line 15, replace "1300°C." with --130°C.--
Column 7, line 58, delete the parenthesis.
Column 9, line 1, replace "poly(m-phenyleneiso-phthalamide)" with --poly(m-phenyleneisophthalamide)--.
Column 9, line 4, replace "1000°C." with --100°C.--.
Column 9, line 4, replace "1500°C. with --150°C.--.
Column 9, line 26, replace "1300°C. with --130°C.
Column 9, line 35, delete the comma after "poly(p".
Column 9, line 38, replace "1000°C." with --100°C.--
Column 9, line 38, replace "1500°C." with --150°C.--
Column 9, line 61, replace "1500°C." with --150°C.--
Column 10, line 8, replace "1000°C." with --100°C.--.
Column 10, line 9, replace "1500°C." with --150°C.--.
Column 10, line 43, replace "700°C." with --70°C.--.
Column 10, line 43, replace "1000°C." with --100°C.--.

UNITED STATES PATENT AND TRADEMARK OFFICE

CERTIFICATE OF CORRECTION

PATENT NO. : 5,306,312
DATED : April 26, 1994
INVENTOR(S) : RIGGINS ET AL

It is certified that error appears in the above-identified patent and that said letters patent is hereby corrected as shown below:

Column 10, line 58, replace "700°C." with --70°C.--.
Column 10, line 66, replace "(c)" with --(b)--.
Column 11, line 27, replace "700°C." with --70°C.--.
Column 11, line 27, replace "980°C." with --98°C.--.
Column 11, line 55, replace "1000°C." with --100°C.--.
Column 11, line 55, replace "1500°C." with --150°C.--.
Column 12, line 4, replace "1500°C." with --150°C.--.
Column 12, line 10, replace "dyelgath" with --dyebath--.
Column 12, line 48, replace "with little fibers" with --within the fibers--.
Column 12, line 61, replace "pyrrolidones" with --pyrrolidone--.
Column 12, line 64, replace "Breaming" with --steaming--.
Column 13, line 11, delete the space after "poly" so that it reads --poly(m-phenyleneisophthalamide)--.
Column 13, line 33, delete the "s" in "pyrrolidones".
Column 13, line 40, replace "1000°C." with --100°C.--.
Column 13, line 55, replace "scourging" with --scouring in--.
Column 14, line 2, replace "excellent" with --repellent--.
Column 14, lines 15 and 16, replace "N-cyclohexyl-2-pyrrolidionel" with --N-cyclohexyl-2-pyrrolidone--.
Column 14, line 25, replace "bout" with --about--.
Column 14, line 32, delete the comma after "ratio".

Signed and Sealed this

Fourth Day of October, 1994

*Attest:*

*Attesting Officer*

Bruce Lehman

BRUCE LEHMAN

*Commissioner of Patents and Trademarks*